United States Patent [19]

Burrell

[11] Patent Number: 4,502,624

[45] Date of Patent: Mar. 5, 1985

[54] OCTAGONAL CONTAINER AND BLANK THEREFOR

[75] Inventor: David E. Burrell, Chicago, Ill.

[73] Assignee: Owens-Illinois, Inc., Toledo, Ohio

[21] Appl. No.: 503,479

[22] Filed: Jun. 13, 1983

[51] Int. Cl.[3] ..... B65D 5/08

[52] U.S. Cl. ..... 229/41 C; 229/38

[58] Field of Search ..... 229/41 C, 41 D, 38, 229/39 R, 23 R, 23 BT; 206/386

[56] References Cited

U.S. PATENT DOCUMENTS

| | | | |
|---|---|---|---|
| 2,013,691 | 9/1935 | Martinson | 229/41 C |
| 2,047,804 | 7/1936 | Shapiro | 229/41 C |
| 3,622,065 | 11/1971 | Butterfill | 229/38 |
| 3,661,319 | 5/1972 | Koehler | 229/41 C X |
| 3,907,194 | 9/1975 | Davenport et al. | 229/41 C X |
| 3,945,558 | 3/1976 | Elder | 229/41 C X |
| 4,199,098 | 4/1980 | Lopez | 229/41 C |
| 4,441,649 | 4/1984 | Nederveld | 229/38 |

FOREIGN PATENT DOCUMENTS

| | | | |
|---|---|---|---|
| 1293077 | 4/1969 | Fed. Rep. of Germany | 229/38 |

*Primary Examiner*—William Price
*Assistant Examiner*—Gary E. Elkins
*Attorney, Agent, or Firm*—John R. Nelson; Myron E. Click

[57] ABSTRACT

An improved octagonal bulk bin container is shown, the bin being made from a foldable blank. The blank forms a bottom closure including four generally rectangular connecting flaps, each connecting flap being located between an end flap and a side flap. Each connecting flap has a score line running from its outer edge diagonally to an interior flap corner. A slot is provided in the plane of the diagonally running score line to help secure the bottom closure when a portion of the end flap is inserted into the slot.

10 Claims, 5 Drawing Figures

OCTAGONAL CONTAINER AND BLANK THEREFOR

The present invention relates to an octagonal container and a blank for making the same. The invention more particularly relates to a foldable blank having end flaps that fold into a strong, easily formed, secure bottom closure.

It is an object of the present invention to provide a foldable blank and an octagonal container made therefrom, the container being especially adapted for use as a bulk bin for various products such as meats, coated sands and resins.

It is an object of the present invention to provide an improved corrugated paper bulk bin container that is easily formed into an octagonal container with an easily formed, secure bottom closure.

It is an object of the present invention to provide an integral blank of foldable material for forming an octagonal shaped container, the blank forming a bottom closure that includes foldable end closure flaps and foldable side closure flaps, the bottom closure including generally rectangular connecting closure flaps, each connecting flap being located between each side flap and each end flap, each connecting flap having a score line running from its outer edge diagonally from its outer edge to one interior corner of the rectangular connecting flap, and there being provided a slot in the plane of the score line to help secure the bottom closure when a portion of the end flap is inserted into the slot.

It is an object of the present invention to provide a blank and an octagonal bulk pin made therefrom the bottom closure of the bin being provided with angle fold of closure end connecting flaps with adjacent corner end flaps, leaving only two width side flaps of the closure to be tucked and guided through the angle cut area of slightly prefold and then the fold and closure can be easily completed with one motion of all flaps.

These and other objects will be apparent from the specification that follows, the appended claims, and the drawings, in which:

Figure 1:
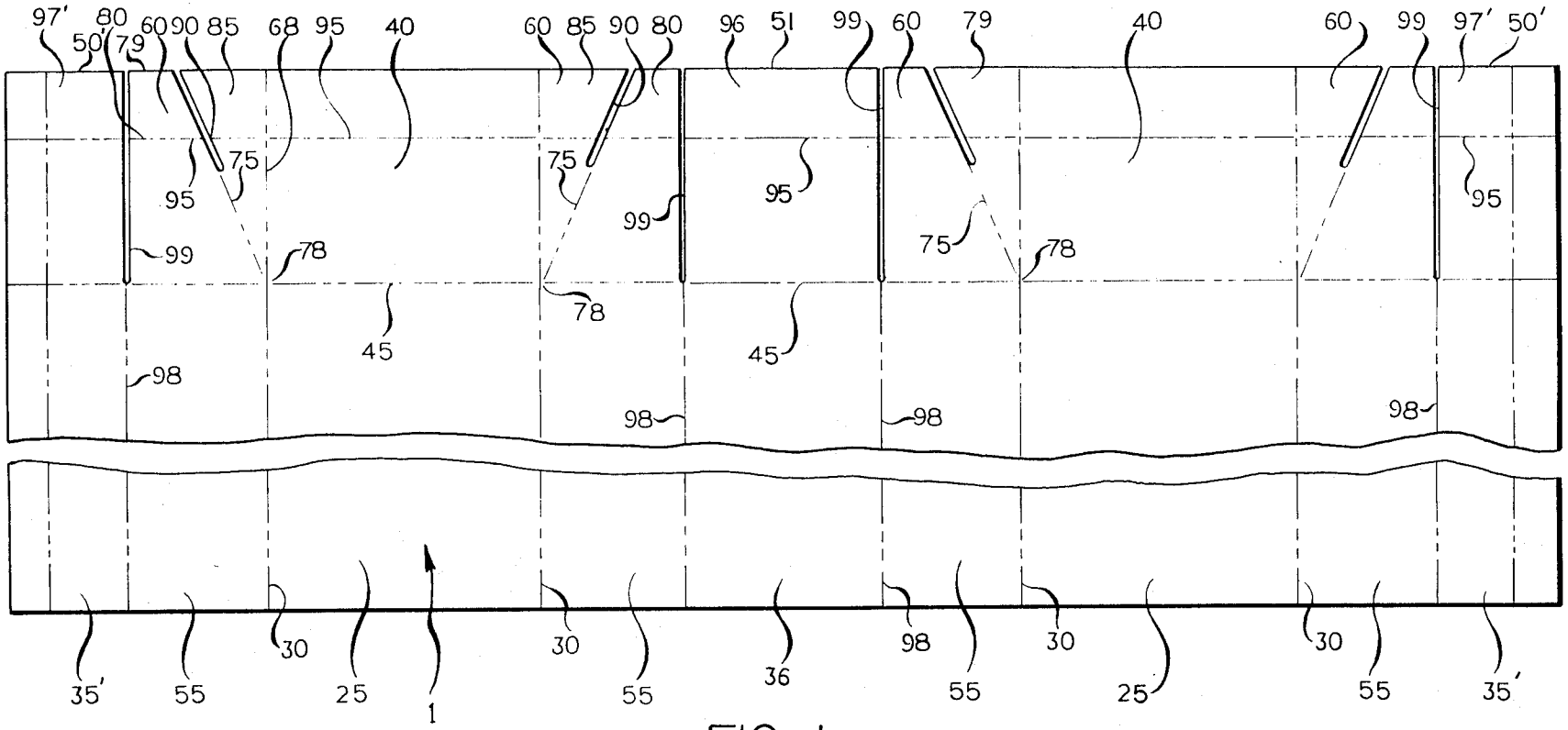
FIG. 1 is a plan view of the blank of the present invention that is easily folded into the novel bulk bin octagonal container of the present invention.
Figure 3:
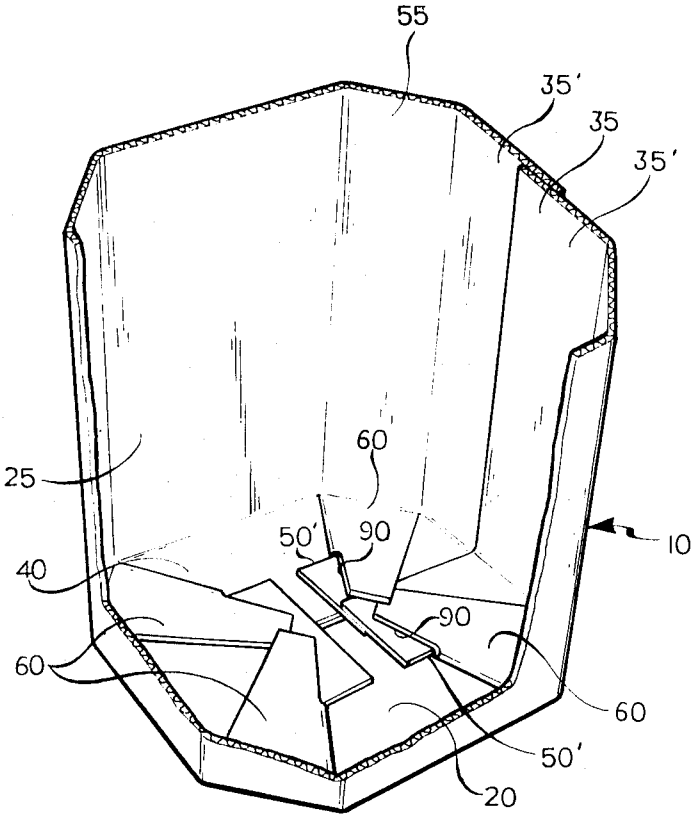
FIG. 3 is a perspective view of the container right side up, with parts cut away to show the folded bottom closure.
Figure 2:
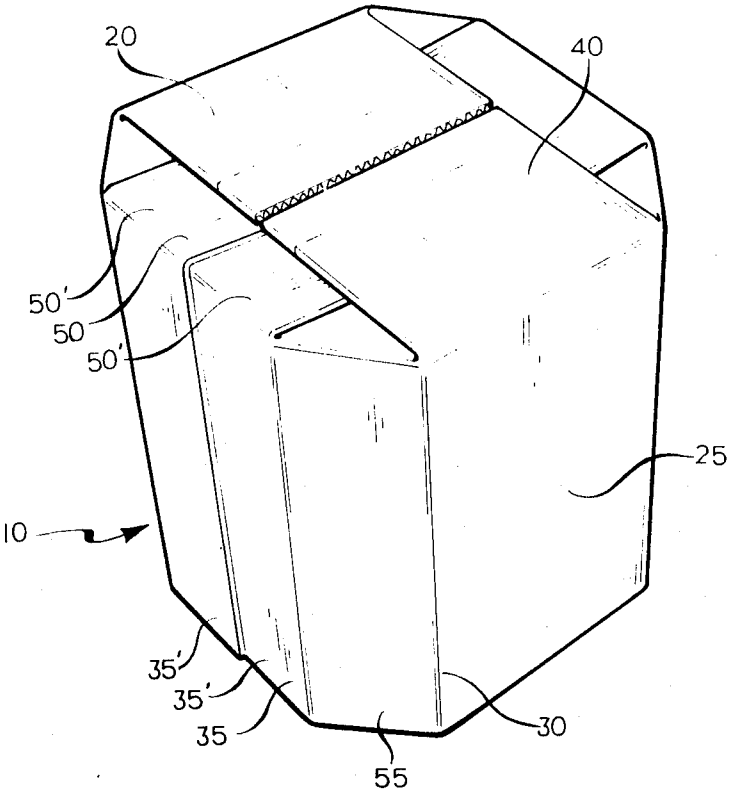
FIG. 2 is a perspective view of the folded blank showing the octagonal container in its upside down position to better illustrate the novel bottom closure.
Figure 5:
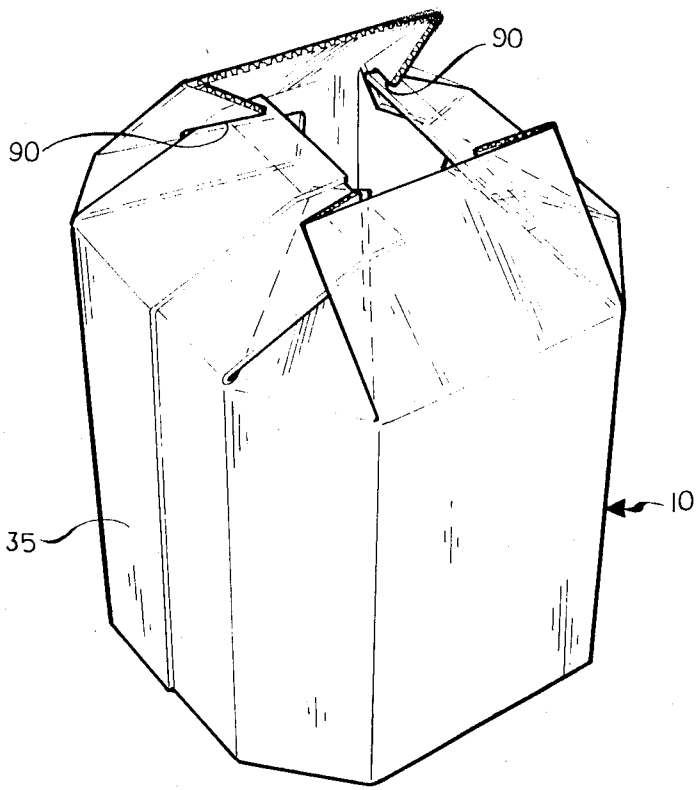
FIG. 5 shows the blank of FIG. 4 with the closure flaps partially folded and shows the position of the flaps just before the closure is completed.
Figure 4:
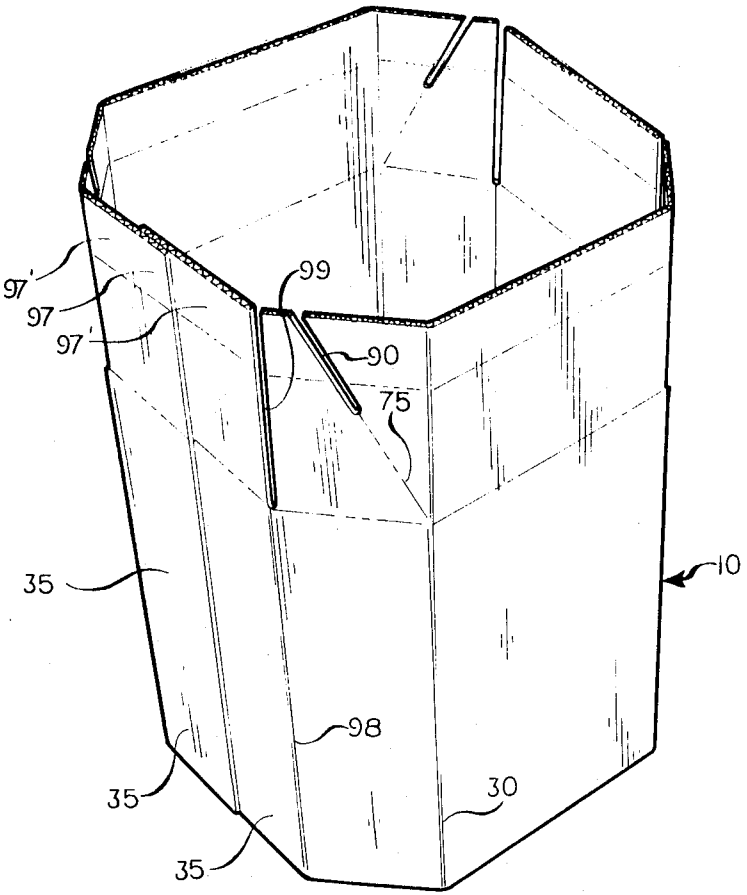
FIG. 4 shows the partially folded blank before the closure flaps are folded into place.

The present invention provides a novel, easily folded integral blank of foldable material for forming a polygonal shaped container, the blank comprising a plurality of generally rectangular side panels, end panels and connecting panels connected together by score lines and adapted to fold into an octagonal shaped container. The blank has two side panels, two end panels and four connecting panels. The blank has a pair of opposed generally rectangular side closure flaps hingeably connected to selected alternate side panels, each side flap having a width substantially equal to the width of its associated side panel, a pair of opposed generally rectangular end closure flaps hingeably connected to associated end panels, one of the end flaps and its associated end panel being formed by ends of the blank being folded together into an octagonal shape and each end flap being opposite the other, each end flap being located in alternate arrangement to each side flap around the octagonal periphery, a pair of opposed connecting panels on each side of each side panel, a pair of opposed connecting closure flaps hingeably connected to associated connecting panels, there being a connecting flap between each side flap and each end flap, the connecting flap being generally rectangular and hingeably connected to the top of its associated connecting panel, one edge of each connecting flap hingeably connected to an edge of its adjacent side flap, the connecting flap having a score line starting at one corner of the connecting flap where it is connected to its associated connecting panel at the edge of the score line of its adjacent side panel, the connecting flap score line running generally from the corner to the outer edge of the flap to divide the flap into two members, there being a slot following the plane of the score line starting from the outer edge of the connecting flap and going in a direction toward the corner, the connecting flap, when the blank is folded to form a closure, providing a slot for receiving the outer edge of its adjacent end flap to secure the same in a folded position, each end flap being held in the folded position by the slot formed at each outer edge of the connected flaps, each of the side flaps when folded being outside the folded end flaps to provide a folded secure closure.

In a preferred embodiment, the slot in the connecting flap is of a length sufficient to accept about one-half the width of its folded associated end flap.

As seen in the drawings, a blank 1 is provided that is easily folded into a bulk pin octagonal container 10 having an easily formed, secure, bottom closure 20.

The blank 1 of foldable material such as corrugated board is an integral one-piece blank adapted for easy, quick folding in the container 10, the blank comprising a plurality of generally rectangular side panels 25 connected together by score lines 30 and adapted to fold into sides of the octagonal shaped container 10. There is provided partial end panels 35' at each end of the blank which are preferably folded over each other slightly and held together by suitable means such as adhesive to form end panel 35. There also is provided end panel 36 for the opposite end of the octagonal shaped container. Each of the end panels 35 and 36 is located between the side panels 25. Generally, the side panels 25 have a width greater than that of the end panels 35 (formed from 35' and 35') and 36, the container being especially adapted for carrying by a pallet underneath the same, the pallet generally being of a rectangular shape in the plan view.

A pair of opposed generally rectangular side closure flaps 40 is provided, the flaps 40 being hingeably connected to selected alternate side panels 25 by score lines 45. Each side flap generally has a width substantially equal to the width of its associated side panel.

A pair of opposed generally rectangular end closure flaps 50 and 51 are provided. End flap 50 is formed from the ends of the blank 50' that are folded together, preferably with some overlap, and held by glue or an adhesive. Each of the flaps 50 (formed by 50' and 50') and 51 is hingeably connected to its associated end panel 35 or 36. As stated, one of the end flaps, flap 50 and its associated end panel 35 are formed by folding the blank 1 into the octagonal shape, overlapping the panels 35', 35' and securing with adhesive or other suitable means.

It can be seen that each end flap is located in alternate arrangement to each side flap around the octagonal periphery. Also, it can be seen that there is shown a pair of opposed connecting panels 55 on each side of each of the side panels 25 and a pair of opposed connecting closure flaps 60 hingeably connected to their associated connecting panels 55. As seen in the drawings, there is a connecting flap 60 between each side flap and each end flap.

Each connecting flap 60 is generally rectangular and hingeably connected to the top of its associated connecting panel by the score line 45. One edge 68 of each connecting flap 60 is hingeably connected to its adjacent side flap 40 by the common score line 30.

The connecting flap has a score line 75 starting at one corner 78 of the flap where it is connected to its associated side panel and associated side flap as well as its associated connecting flap. The corner 78 is formed where the score lines 30 and 45 cross. The score line 75 generally runs from the corner 78 to the outer edge 79 of the flap 60 to divide the flap 60 into two members 80 and 85. In a preferred embodiment the member 80 is a trapezoid in shape and the member 85 is triangular in shape.

A slot 90 is provided in each connecting flap 60, the slot 90 generally following the plane of the score line 75. As seen in the drawings, slot 90 starts at the outer edge 79 of the flap 60 and preferably is of sufficient length to accept about one-half the width of its associated end flap 50 or 51.

It can be seen that the connecting flap 60, when the blank is folded to form the bottom closure, provides the slot 90 to receive the end flaps to easily form a secure closure.

A score line 95 is provided on the end flaps 50 and 51 to form outer flap portions 96 and 97 (formed from 97' and 97') all hingeably connected to the rest of their respective flaps to provide for easy insertion into the slots when the blank is folded to form the bottom closure 20.

The bulk bin container 1 of the present invention provides a sturdier, more easily folded blank with a secure bottom closure than those of the prior art. Coated sand or other heavy products will firmly weigh down and secure the closure.

In the art, U.S. Pat. No. 3,907,194 to Davenport et al shows a blank and octagonal container. The blank 1 and container 10 of the present invention are different from and improved over the above mentioned blank and container.

The connecting flaps 60 of the present invention are so constructed and arranged that there is one straight score line 75 going from the interior corner 78 to the outer flap edge 79. The slot 90 is in the plane of the score line 75 for easy and secure formation of the closure. As seen in the U.S. Pat. No. 3,907,194 the score line does not go to the outer edge of the flap and the slot is not in the same plane as the score line. There are no isosceles triangle shaped end flaps in the present invention which appear to be the main thrust of the Davenport et al patent.

As seen in FIG. 1, score lines 30 are located on each side of each of the side panels 25. Shorter score lines 98 are provided between each of the connecting panels 55 and each end panel 36 or 35 (formed from 35' and 35'). There are four score lines 98, each score line 98 terminating in a slot 99 in the same plane as the score line 98. Each of the slots 99 separate one edge of the connecting flap from the adjacent end closure flap. Thus, there is no connection between adjacent connecting flaps and end flaps.

What is claimed is:

1. An integral blank of foldable material for forming a polygonal shaped container, the blank comprising a plurality of generally rectangular side, end, and connecting panels connected together by score lines to define pairs of side panels and end panels, each side panel and end panel separated by one of the connecting panels, the panels being adapted to fold into an octagonal shaped container, there being corresponding closure flaps attached to each of the panels including a pair of opposed generally rectangular side closure flaps hingeably connected to alternate side panels, each side flap having a width substantially equal to the width of its associated side panel, a pair of opposed generally rectangular end closure flaps hingeably connected to associated end panels, each end flap being located in alternate arrangement to each side flap around the octagonal periphery, a pair of opposed connecting closure flaps hingeably connected to the associated connecting panels, there being four connecting flaps whereby there is a connecting flap between each side flap and each end flap, the connecting flap being generally rectangular and hingeably connected to the top of its associated connecting panel, one edge of each connecting flap hingeably connected to an edge of its adjacent side flap, there being no connection between the the connecting flap and its adjacent end flap, the connecting flap having a score line starting at one corner of the connecting flap where it is connected to its associated connecting panel at the edge of the score line of its adjacent side flap, the connecting flap score line running generally from the corner towards the outer edges of the flap to divide the flap into two members, there being a connecting flap slot following the plane of the score line starting from the outer edge of the connecting flap and going in a direction toward the corner, the connecting flap, when the blank is folded to form a closure, providing the connecting flap slot for receiving the outer edge of its adjacent end flap to secure the same in a folded position, each end flap being held in the folded position by the connecting flap slot formed at each outer edge of the connecting flaps.

2. A blank as defined in claim 1 in which the connecting flap slot in one of the connecting flaps is of sufficient length ot accept about one-half the width of its folded associated end flap.

3. A blank as defined in claim 1 in which there is a score line on each of the end flaps generally perpendicular to the score lines forming the end panels to form an outer flap portion on each end flap, the end flap outer portion being hingeably connected to the rest of the flap to provide for easier insertion into the associated connecting flap slots.

4. A blank as defined in claim 1 in which the score line of each of the connecting flaps divides each of the flaps into a trapezoidal member and a triangular member.

5. A blank as defined in claim 1 in which one of the end flaps and its associated end panel is formed by folding the blank into an octagonal shape.

6. A blank as defined in claim 1 in which each of the side flaps when folded is located outside the end flaps to form a secure closure.

7. An octagonal container made from an integral blank of foldable material, the blank comprising a plurality of generally rectangular side, end, and connecting panels connected together by score lines to define pairs of side panels and end panels, each side panel and end panel separated by one of the connecting panels, the panels being adapted to fold into an octagonal shaped container, there being corresponding closure flaps attached to each of the panels including a pair of opposed generally rectangular side closure flaps hingeably connected to alternate side panels, each side flap having a width substantially equal to the width of its associated side panel, a pair of opposed generally rectangular end closure flaps hingeably connected to associated end panels, each end flap being located in alternate arrangement to each side flap around the octagonal periphery, a pair of opposed connecting closure flaps hingeably connected to associated connecting panels, there being four connecting flaps where there is a connecting flap between each side flap and each end flap, the connecting flap being generally rectangular and hingeably connected to the top of its associated connecting panel, the edge of each connecting flap hingeably connected to an edge of its adjacent side flap, the connecting flap having a score line starting at one corner of the connecting flap where it is connected to its associated connecting panel at the edge of the score line of its adjacent side flap, the connecting flap score line running generally from the corner towards the outer edge of the flap to divide the flap into two members, there being a connecting flap slot following the plane of the score line starting from the outer edge of the connecting flap and going in a direction toward the corner, the connecting flap, when the blank is folded to form a closure, providing the connecting flap slot for receiving the outer edge of its adjacent end flap to secure the same in a folded position, each end flap being held in the folded position by the slot formed at each outer edge of the connecting flaps.

8. A container as defined in claim 7 in which the connecting flap slot in the connecting flap is of a sufficient length to accept about one-half the width of its associated end flap.

9. A container as defined in claim 7 in which there is a score line on the end flap generally perpendicular to the score lines forming the end panels, the outer portion of the end flap being hingeably connected to the rest of the connecting flap for easy insertion into the associated connecting flap slots when the folded closure is made.

10. A container as defined in claim 7 in which there is no connection between one of the connecting flap and its adjacent end flap before folding.

* * * * *